United States Patent [19]

Chen et al.

[11] Patent Number: 4,918,789

[45] Date of Patent: Apr. 24, 1990

[54] TRIPOD CLIP

[76] Inventors: Haw-Renn Chen; Feichu H. Chen, both of 4057 Little Hollow Pl., Moorpark, Calif. 93021

[21] Appl. No.: 237,947

[22] Filed: Aug. 29, 1988

[51] Int. Cl.[5] ..... B42F 1/02

[52] U.S. Cl. ..... 24/67.9; 24/546

[58] Field of Search ..... 24/67 R, 67.3, 67.9, 24/545, 546

[56] References Cited

U.S. PATENT DOCUMENTS

| | | | |
|---|---|---|---|
| 850,185 | 4/1907 | Roberts | 24/546 |
| 1,449,684 | 3/1923 | Long et al. | 24/545 |
| 1,780,893 | 11/1930 | Schmitt | 24/546 |
| 1,985,866 | 12/1934 | Lankenau | 24/546 |
| 2,323,552 | 7/1943 | Marion et al. | 24/546 |
| 2,781,566 | 2/1957 | Hammer | 24/67.9 |
| 3,057,027 | 10/1962 | Bugge | 24/67.9 |
| 3,083,425 | 4/1963 | Minnerly, Jr. | 24/67.9 |
| 3,913,181 | 10/1975 | Walker | 24/67.9 |
| 4,497,091 | 2/1985 | Elliott | 24/67.9 |

FOREIGN PATENT DOCUMENTS

| | | | |
|---|---|---|---|
| 814290 | 9/1951 | Fed. Rep. of Germany | 24/67.9 |

*Primary Examiner*—Victor N. Sakran

[57] ABSTRACT

A clip with triangular cross section is a paper clip provided with a step, which is vertical to the planes formed by the clip wire, at the narrower end of the U-shaped clip wire such that two planes constructed by the U-shaped clip wire are formed by the step. These two planes are made to tilt toward each other at the end opposite from the end where the step is formed such that the clip with triangular cross section is capable of clipping either thin or thick stack of papers or any sort of sheets.

1 Claim, 1 Drawing Sheet

TRIPOD CLIP

BACKGROUND OF THE INVENTION

A conventional clip is widely used to holding a stack of papers or other kinds of sheets togather. It is not only very convenient but also economical to use a clip. However, as the clipped stack being thick, a clip may deform too much to be able to hold the stack of sheets or papers steadily. The present invention is concerned with this problem, and the general aim of this invention is to provide a renovated clip with triangular cross section which not only reserves the convenience and economy of a clip and eliminates the shortcoming of a conventional clip when clipping a thick stack of papers or sheets, but also can be shaped to be more versatile than a conventional clip under various clipping requirements.

SUMMARY OF THE INVENTION

In accordance with the present invention, a clip is improved by adding a step on it. The step is provided at the narrower end of the U-shaped clip wire such that two planes constructed by the U-shaped wires are formed by the step. These two U-shaped wire planes formed by the step can enhance the capability of the present invention to clip a thick paper stack without undertaking excessive wire deformation during clipping. For getting better clipping efficiency, the planes are tilted toward each other such that the U-shaped wire planes are close to each other at the end opposite from where the step is formed.

DETAIL DESCRIPTION OF THE EMBODIMENT

Figure 1:
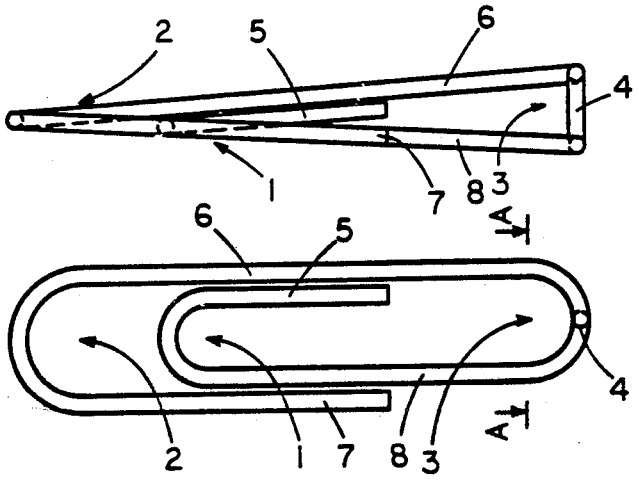
FIG. 1 shows the top view and side view of the basic configuration of the present invention.

A clip with triangular cross section is made of material with good elasticity property such as steels, plastics, or others. As shown in FIG. 1, a clip with triangular cross section is constructed with a wire shaped with three different sizes of U-shapes which are connected to each other at one end of the U-shapes. While the smallest U-shape as indicated by numeral 1 in FIG. 1 is sitting inside the largest U-shape as indicated by 2, the medium-size U-shape, 3, is sitting at the open end of 1 and 2.

Figure 2:
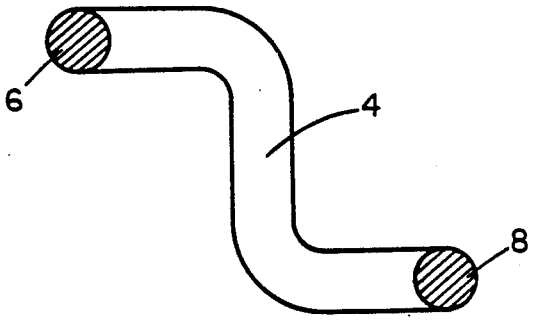
FIG. 2 shows the enlarged projectory sectional view taken along the line A—A in FIG. 1.

As indicated by 4 in FIG. 1 and FIG. 2, a step is formed at the center of the closed end of U-shape 3 such that the plane of U-shape 1 is displaced from the plane of U-shape 2. In adition, as can be seen in the side view of FIG. 1, U-shapes 1 and 2 are made to tilt against each other such that the closed end of U-shape 1 is close to the plane of U-shape 2. The combination of step 4 and tilted U-shape planes makes the clip with triangular cross section holding a thick stack of sheets or papers have a smaller and more uniform deformation than a conventional clip. Hence, a clip with triangular cross section can hold a thick stack more secure than a conventional clip can.

Numeral 5 is a leg with free end of U-shape 1 and is tilted in the direction parallel to wire segment 6, which is the wire segment connecting U-shape 2 and U-shape 3, while numeral 7 is a leg with free end of U-shape 2 and is tilted in the direction parallel to wire segment 8, which is the wire segment connecting U-shape 1 and U-shape 3. This configuration makes the clip with triangular cross section be able to hold a stack of papers with three holding points at the base of 2, tip of 5, and tip of 7. In addition, the tips of 5 and 7 have the function of preventing the tripod clip from slipping out of the clipped paper stack.

We claim:

1. A clip with triangular cross section comprising three U-shapes with the smallest U-shape sitting inside the largest U-shape and the medium-size U-shape with two legs connected to one leg of each of said largest and smallest U-shapes sitting at the open end of said smallest and largest U-shapes contains one or more vertically-formed curvatures in the manner that said two legs of said medium-size U-shape lie on two planes with different orientation such that said smallest U-shape and said largest U-shape lie on said two planes while the leg with free end of said smallest U-shape is bent to be somewhat in parallel to said largest U-shape plane and the leg with free end of said largest U-shape is bent to be somewhat in parallel to said smallest U-shape plane whereby the capability of clipping a thick stack of paper or the like for said clip with triangular cross section is better than a clip without said vertically-formed curvatures.

* * * * *